US010280545B2

(12) United States Patent
Ku et al.

(10) Patent No.: US 10,280,545 B2
(45) Date of Patent: May 7, 2019

(54) VAPOR-LIQUID SEPARATOR AND CLOTHES TREATING APPARATUS HAVING THE SAME

(71) Applicant: LG ELECTRONICS INC., Seoul (KR)

(72) Inventors: Sejin Ku, Seoul (KR); Yeongju Kim, Seoul (KR); Taekyoung Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 180 days.

(21) Appl. No.: 15/397,161

(22) Filed: Jan. 3, 2017

(65) Prior Publication Data

US 2017/0191201 A1 Jul. 6, 2017

(30) Foreign Application Priority Data

Jan. 5, 2016 (KR) ..... 10-2016-0001191

(51) Int. Cl.

| | |
|---|---|
| ***F25B 43/00*** | (2006.01) |
| ***D06F 25/00*** | (2006.01) |
| ***D06F 37/04*** | (2006.01) |
| ***D06F 39/04*** | (2006.01) |
| ***D06F 39/12*** | (2006.01) |

(52) U.S. Cl.

CPC ..... *D06F 25/00* (2013.01); *D06F 37/04* (2013.01); *D06F 39/04* (2013.01); *D06F 39/12* (2013.01); *F25B 43/006* (2013.01); *D06F 2232/10* (2013.01); *F25B 2400/23* (2013.01); *F25B 2500/01* (2013.01); *F25B 2500/17* (2013.01)

(58) Field of Classification Search

CPC ..... D06F 25/00; D06F 37/04; D06F 39/04; D06F 39/12; D06F 2232/10; F25B 43/006; F25B 2400/23; F25B 2500/01; F25B 2500/17

See application file for complete search history.

(56) References Cited

U.S. PATENT DOCUMENTS

| | | | | |
|---|---|---|---|---|
| 3,791,575 A * | 2/1974 | Kartinen | B04B 1/06 | 210/103 |
| 4,139,352 A * | 2/1979 | McEwan | B01J 8/228 | 96/220 |
| 4,607,503 A * | 8/1986 | Fry | F25B 43/006 | 62/295 |

(Continued)

FOREIGN PATENT DOCUMENTS

| | | |
|---|---|---|
| CN | 1431440 | 7/2003 |
| CN | 202675764 | 1/2013 |

(Continued)

OTHER PUBLICATIONS

International Search Report dated Mar. 9, 2017 issued in Application No. PCT/KR2016/012804.

(Continued)

*Primary Examiner* — Melvin Jones

(74) *Attorney, Agent, or Firm* — KED & Associates, LLP

(57) ABSTRACT

A vapor-liquid separator includes a casing having an accommodation space, an inlet at the casing to allow a refrigerant mixture fluid to be intaken to the accommodation space therethrough, and an outlet at the side of the inlet to allow a gas phase refrigerant separated from the refrigerant mixture fluid to be discharged therethrough.

24 Claims, 8 Drawing Sheets

(56) References Cited

U.S. PATENT DOCUMENTS

| | | | | |
|---|---|---|---|---|
| 4,683,726 | A * | 8/1987 | Barron | F25B 39/04 62/503 |
| 4,776,183 | A | 10/1988 | Okoma | |
| 5,195,939 | A * | 3/1993 | Gingras | B04B 1/02 494/60 |
| 6,402,799 | B1 | 6/2002 | Kokubo et al. | |
| 2003/0126883 | A1 * | 7/2003 | Saito | F25B 41/00 62/500 |
| 2005/0217312 | A1 | 10/2005 | Arno et al. | |
| 2012/0159800 | A1 * | 6/2012 | Del Pos | D06F 58/04 34/74 |
| 2012/0246960 | A1 | 10/2012 | Lee et al. | |

FOREIGN PATENT DOCUMENTS

| | | |
|---|---|---|
| CN | 104594005 | 5/2015 |
| JP | H 02-140571 | 5/1990 |
| JP | 2000-070632 | 3/2000 |
| JP | 2013-226249 | 11/2013 |
| JP | 2013-245917 | 12/2013 |
| KR | 20-1990-0011272 | 12/1990 |
| KR | 10-2006-0125388 | 12/2006 |

OTHER PUBLICATIONS

European Search Report dated May 4, 2017 issued in Application No. 16204928.2.
Chinese Office Action dated Sep. 30, 2018 issued in Application No. 201611186929.3 (with English Translation).

* cited by examiner

VAPOR-LIQUID SEPARATOR AND CLOTHES TREATING APPARATUS HAVING THE SAME

CROSS-REFERENCE TO RELATED APPLICATION

This application claims the benefit of earlier filing date and right of priority under 35 U.S.C. § 119(a) from Korean Application No. 10-2016-001191, filed Jan. 5, 2016, the subject matter of which is incorporated herein by reference.

BACKGROUND

1. Field

Embodiments may relate to a vapor-liquid separator for separating a gas phase refrigerant, and a liquid phase refrigerant and a clothes treating apparatus having the same.

2. Background

A heat pump system may circulate a refrigerant through an evaporator, a compressor, a condenser, and an expansion valve. The evaporator may absorb a heat source, and the condenser may discharge the heat source. The refrigerant may absorb the heat source so as to change from a liquid phase to a vapor phase (or a gas phase), and discharge the heat source so as to change from the vapor phase to a liquid phase. The gas phase refrigerant may be compressed by the compressor and may subsequently through circulate the condenser, the expansion valve, the evaporator, and the compressor as one cycle.

If a liquid phase refrigerant is introduced together with a vapor phase refrigerant to the compressor, while the compressor operates, the liquid phase refrigerant may be compressed, and thereby cause damage to the compressor.

In order to prevent (or reduce) damage to the compressor, a vapor-liquid separator (or an accumulator) may be connected to an inlet side of the compressor to separate the liquid phase refrigerant and the vapor phase refrigerant.

FIG. 6 is a perspective view illustrating a vapor-liquid separator according to an example arrangement.

As shown in FIG. 6, a vapor-liquid separator 1 may include a refrigerant inlet pipe 2*a* and a refrigerant discharge pipe 2*b*. The refrigerant inlet pipe 2*a* may be provided at an upper portion of a casing 2 to allow a refrigerant discharged from the evaporator to be introduced to inside of the casing 2. The refrigerant discharge pipe 2*b* may be provided in a lower portion of the casing 2 to discharge a gas phase refrigerant separated due to a difference in specific gravity of the refrigerant to the compressor. The vapor-liquid separator 1 may store the liquid phase refrigerant separated from the gas phase refrigerant in the casing 2.

However, since the vapor-liquid separator 1 is manufactured to be connected to a inlet side of a vertical compressor, it may not be applied to a horizontal compressor advantageously used when a height of an installation space of a compressor is small. If the vapor-liquid separator 1 (shown in FIG. 6) is connected to an inlet side of the horizontal compressor, the vapor-liquid separator 1 may protrude upwardly from the horizontal compressor, thereby causing a problem that an overall height of the compressor and the vapor-liquid separator 1 is increased against what was intended in the horizontal compressor.

U.S. Pat. No. 4,776,183 (hereafter Patent Document D1), the subject matter of which is incorporated herein by reference, is titled Lateral Type Accumulator. In order to solve the above problem, Patent Document D1 discloses a horizontal accumulator disposed in a horizontal direction to be parallel to a horizontal compressor.

In an example in which a heat pump system is applied to a clothes treating apparatus (such as a washing machine and/or the like), since a drum and a tub accommodate clothes, and/or the like, occupies a greatest part of an internal space of the clothes treating apparatus, a disposition space to install all of an evaporator, a condenser, a compressor, an expansion valve, a vapor-liquid separator, and/or the like, in the remaining space (excluding the drum and the tub) within the clothes treating apparatus is small.

FIG. 7 is a cross-sectional view illustrating a horizontal accumulator according to an example document, namely Patent Document D1. As shown in FIG. 7, a horizontal accumulator of Patent Document D1 is not problematic when an inlet 37 and an outlet 39 are positioned on opposing sides. However, in an example in which the horizontal accumulator of Patent Document D1 is disposed in a narrow space, the inlet 37 and the outlet 39 may be formed on the same side or in the same direction to avoid interference with respect to other components, and even though the inlet 37 and the outlet 39 are formed on the same side, the following problems may arise.

For example, in a structure of the horizontal accumulator of Patent Document D1, in an example in which the inlet 37 and the outlet 39 are positioned together on the left side, when a mixture of a liquid phase and gas phase refrigerant and oil introduced through a first communication opening 51 passes through an upper space of a liquid phase refrigerant storage space, the liquid phase refrigerant and oil are required to be separated and the gas phase refrigerant is required to be returned toward the outlet. However, since a hole allowing the gas phase refrigerant to be returned is not formed at a second partition plate 47, the gas phase refrigerant may not be able to be returned.

Even if a hole allowing the gas phase refrigerant to be returned is formed in the second partition plate 47, the returned gas phase refrigerant may meet the mixture including the sucked liquid phase refrigerant, or the like, and thereby causing a problem that it is not possible to separate the gas phase refrigerant and the liquid phase refrigerant, an intrinsic function of the vapor-liquid separator.

BRIEF DESCRIPTION OF THE DRAWINGS

Arrangements and embodiments may be described in detail with reference to the following drawings in which like reference numerals refer to like elements and wherein.

DETAILED DESCRIPTION

A vapor-liquid separator and a clothes treating apparatus may be described in detail with reference to the accompanying drawings, in which like numbers refer to like elements. As used herein, the singular forms "a", "an" and "the" are intended to include plural forms as well, unless the context clearly indicates otherwise.

Figure 1A:
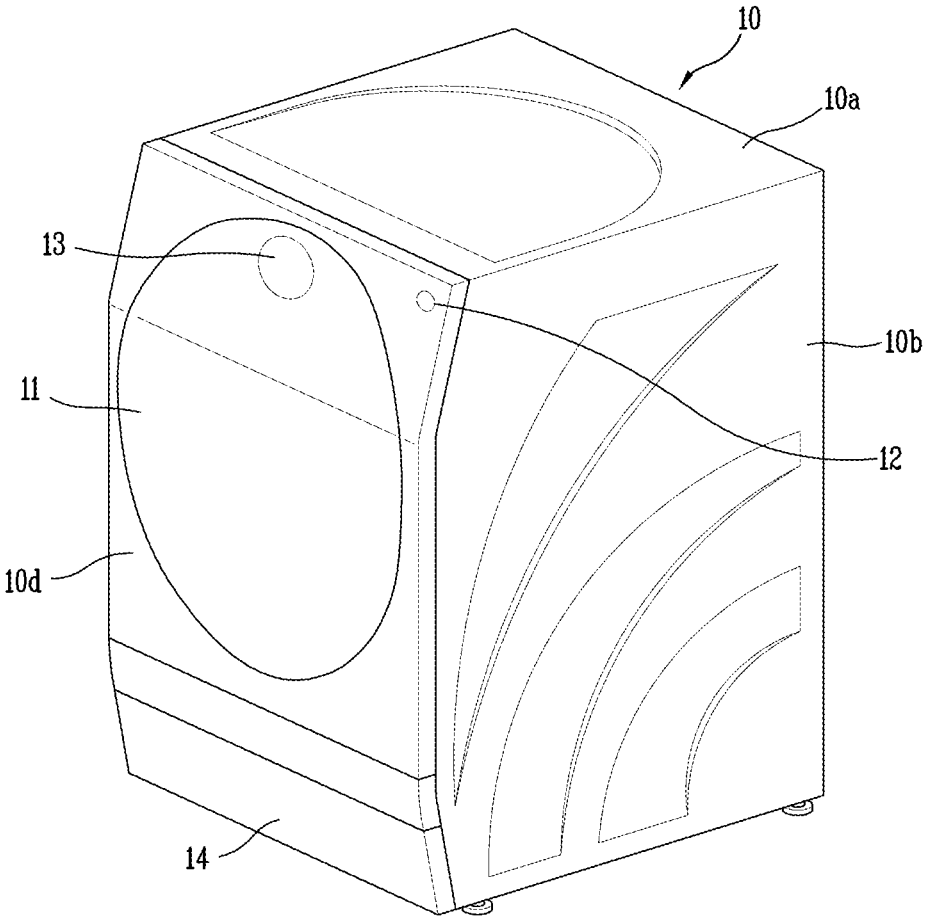
FIG. 1A is a perspective view illustrating an example of a clothes treating apparatus.

FIG. 1A is a perspective view illustrating an example of a clothes treating apparatus. Other embodiments and configurations may also be provided.

A cabinet 10 may form an external frame and an appearance of a clothes treatment apparatus. The cabinet 10 may have a hexahedral shape, for example. The cabinet 10 may include a top cover 10*a* forming an upper surface of the hexahedron, a side cover 10*b* forming opposing sides of the hexahedron, a base cover 10*c* forming a lower surface of the hexahedron, a front cover 10*d* forming a front surface of the hexahedron, and a back cover 10*e* forming a rear surface of the hexahedron.

An opening for introducing the laundry (such as clothes or the like) may be formed on the front cover 10*d*, and a door 11 opening and closing the opening may be provided. The door 11 is coupled to a front cover 10*d* by a hinge on a left side of the opening, and a right side of the door 11 may be rotated in a forward/backward direction. An automatic releasing device for automatically releasing the button type door may be provided on a right portion of the door 11 and on a right portion of the opening, so that when a right end portion of the door 11 is pushed to be closed, the door 11 is locked, and when the closed door 11 is pressed once, the door 11 may be opened.

A power button 12 may be provided on a right upper end of the front cover 10*d* to turn on and off power of the clothes treatment apparatus.

A display unit 13 (or display device) and a touch type control panel may be provided on an upper end portion of the door 11. When a user performs a washing, spin-drying, or drying operation, an operational state of the clothes treatment apparatus may be visible to the user through the display unit 13. Various functions may be selected or selected functions may be released through the touch type control panel.

A detergent supply unit may be provided between a lower side of the tub 17 and the base cover 10*c*, and the detergent supply unit may be drawn out or inserted in a drawer manner. A lower cover 14 may be rotatably provided below the front cover 10*d* in order to cover a front side of the detergent supply unit.

Figure 1B:
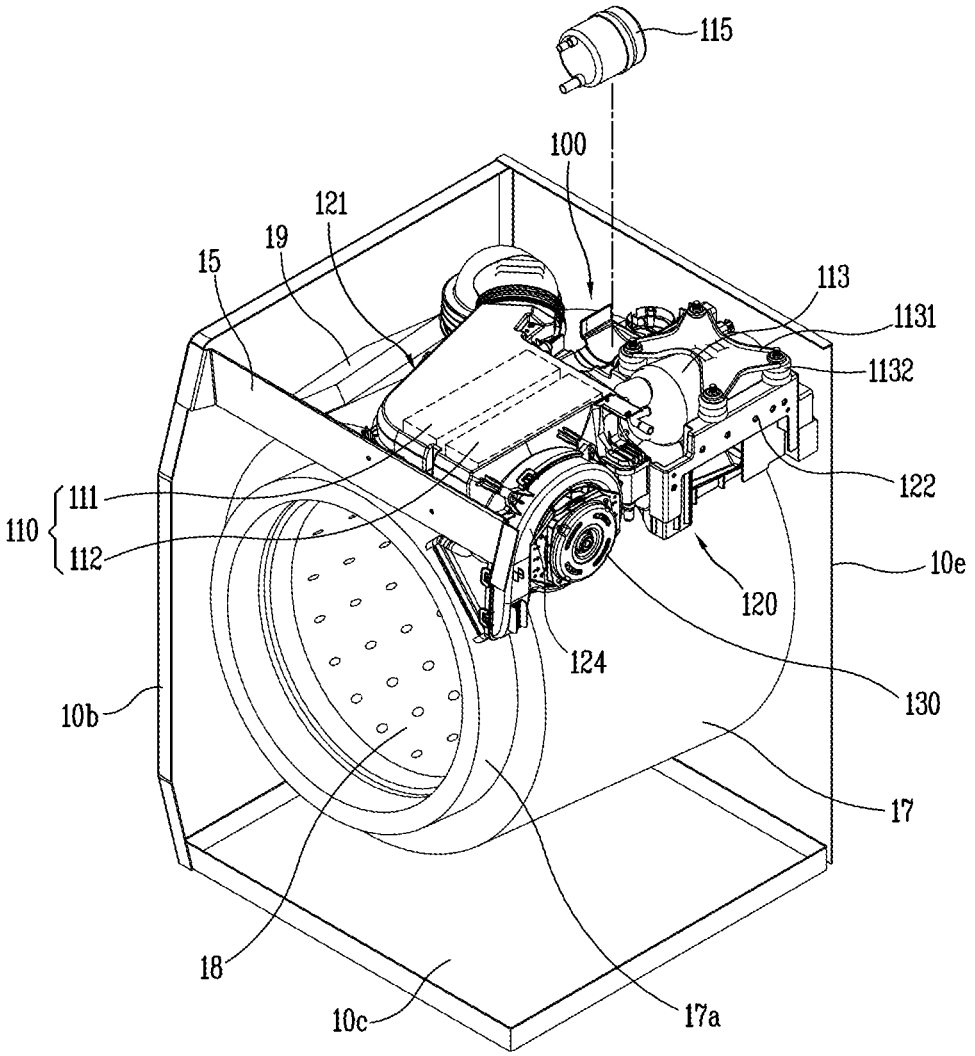
FIG. 1B is a perspective view illustrating a configuration of a heat pump module disposed above a tub.

FIG. 1B is a perspective view illustrating a configuration of a heat pump module disposed above a tub. Other embodiments and configurations may also be provided.

A cylindrical tub 17 may be provided within the cabinet 10. An opening communicating with the opening of the front cover 10*d* may be provided on a front side of the tub 17 to allow laundry and a dry target to be taken in and out. A hollow part may be provided within the tub 17 to store washing water. A gasket 17*a* extends from the opening of the tub 17 to the opening of the front cover 10*d* in a circumferential direction to prevent leakage of washing water kept in the tub 17 to outside and prevent transmission of vibration generated in the tub 17 to the cabinet 10 when the drum 18 is rotated. The gasket 17*a* may be formed of a vibration insulating member such as rubber. An air outlet is formed on upper rear side of the tub 17 to allow air to be discharged from the tub 17. An air inlet may be provided in an upper portion of the gasket 17*a* of the tub 17 to allow air to be introduced to the tub 17.

A cylindrical drum 18 may be rotatably provided within the tub 17. The drum 18 may have an accommodation space for accommodating laundry and a dry target therein. The cylindrical drum 18 may have an opening formed on a front side of the drum 18 and communicating with the opening of the tub 17. The drum 18 may have a plurality of through holes formed on an outer circumferential surface thereof to allow washing water and air to pass through the through holes between the drum 18 and the tub 17. A lifter is installed at an interval in a circumferential direction within the drum 18, to tumble laundry introduced to the inside of the drum 18. For example, in a washing cycle, washing water supplied to the tub 17 is introduced to the inside of the drum 18 through the through holes, and when the drum 18 is rotated, the laundry introduced to the inside of the drum 18 is wet to be washed. In a drying cycle, hot air supplied to the inside of the tub 17 is introduced to the inside of the drum 18 through the through holes, and as the drum 18 rotates, moisture of laundry introduced to the inside of the drum 18 is evaporated by hot air to dry the laundry.

The heat pump module 100 may integrally modularize an evaporator 111, a compressor 113, a condenser 112, and an expansion valve 114 by an integral housing 120. A circulation fan 130 for providing power to air and a vapor-liquid separator 115 for separating a gas phase refrigerant and a liquid phase refrigerant may also be integrally installed at the integral housing 120.

The modularized heat pump module 100 may be disposed between an upper portion of the tub 17 and the top cover 10*a*.

The integral housing 120 may include a heat exchange duct unit 121 for accommodating the evaporator 111 and the condenser 112, and a compressor base part 122 for supporting the compressor 113.

The heat exchange duct unit 121 may be disposed on a front side in an upper portion of the tub 17, may accommodate and support the heat exchanger 110 therein, and may be connected to the tub 17 to serve as a circulation duct forming a circulation flow channel for circulating air. The heat exchanger 110 may include the evaporator 111 and the condenser 112. The evaporator 111 and the condenser 112 may be installed within the heat exchange duct unit 121 and may be spaced apart from each other in a direction perpendicular to a rotation central line of the drum.

The compressor base part 122 may support the compressor 113 disposed in a space between an upper portion of the tub 17 and a side corner of the cabinet 10.

The integral housing 120 may be supported in a forward/backward direction by a front side of the cabinet 10 (e.g. a front frame 15), and an upper portion of the back cover 10*e* as a rear side of the cabinet 10. A front side of the heat exchange duct unit 121 may contact a rear surface of the front frame 15, and may be fastened by a fastening member such as a screw, or the like. A rear side of the compressor base part 122 may contact a front side of the back cover 10*e*, and may be fastened by a fastening member such as a screw.

The integral housing 120 may be spaced apart from an upper outer circumferential surface of the tub 17 to prevent transmission of vibrations (generated by the drum 18 when the drum 18 rotates) to the heat pump module 100 through the tub 17.

Since the evaporator 111, the compressor 113, the condenser 112, the expansion valve, and the like, forming a heat pump cycle are integrated by the integral housing 120, a disposition space of a heat pump system may be compactly optimized.

The heat pump module 100 may intake air discharged from the drum 18 and heat-exchange it with the evaporator 111 to absorb heat from the air through the evaporator 111 and remove moistures in the air (dehumidification function of the heat pump module 100). The heat pump module 100 may heat-exchange air discharged from the evaporator 111 with the condenser 112 to discharge heat from a refrigerant passing through the condenser 112 as air to be re-supplied to the inside of the tub through the condenser 112 (air heating function of the heat pump module 100).

The heat pump module 100 may include a circulation fan 130 for intaking air discharged from the drum 18. The circulation fan 130 may be accommodated and supported in the fan duct unit 124. The circulation fan 130 may be integrally coupled to the right side of the heat exchange duct unit 121 by the fan duct unit 124.

The vapor-liquid separator 115 may be installed in a vapor-liquid separator mounting part 123 and may be compactly disposed on the rear side of the heat exchange duct unit 121 above the tub 17. The vapor-liquid separator mounting part 123 may be integrally formed between a rear side of the heat exchange duct unit 121 and the left side of the compressor base part 122. The vapor-liquid separator 115 may be disposed between the evaporator 111 and the compressor 113. The vapor-liquid separator 115 may be connected to the evaporator 111 and the compressor by a refrigerant pipe. The vapor-liquid separator 115 may have a cylindrical shape. The vapor-liquid separator, as a horizontal vapor-liquid separator 115, may be compactly disposed even in a narrow space above the tub 17, and an inlet 1151*a*1 and an outlet 1151*a*2 may be provided on a same side in order to avoid interference with other components. For example, the inlet 1151*a*1 and the outlet 1151*a*2 may be disposed to face each other toward the evaporator 111 of the heat exchange duct unit 121. The horizontal vapor-liquid separator 115 may be horizontally disposed so as to be positioned to be lower than a height of the compressor 113.

A control unit (or controller) may control general operation(s) of the clothes treatment apparatus, as well as the heat pump module 100. The control unit may include a Printed Circuit board (PCB) case having a flat rectangular box shape in which a height thereof is lower than a width and a length thereof, a PCB installed within the PCB case 19, and electric/electronic control components installed at the PCB.

Figure 1C:
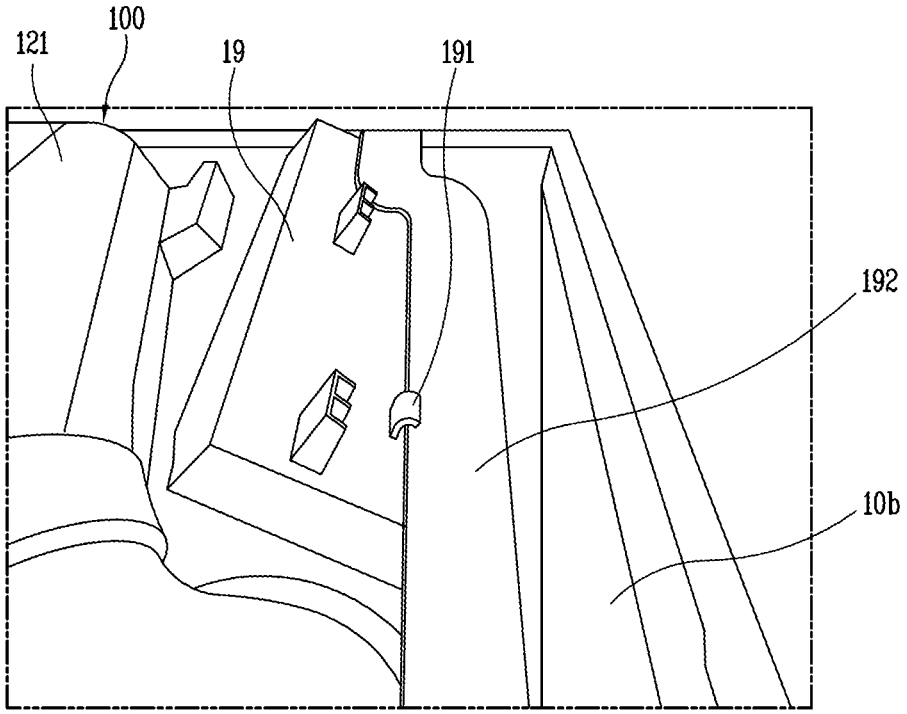
FIG. 1C is a rear perspective view illustrating a fixed structure of a PCB case (of FIG. 1B)

FIG. 1C is a rear perspective view illustrating a fixing structure of a PCB case (of FIG. 1B). Other embodiments and configurations may also be provided.

The PCB case 19 may be disposed on a left side of the heat pump module 100 in a diagonal direction (when viewed from the front cover 10*d*) by using a space between the upper side of the tub 17 and the left side corner of the cabinet 10.

A width of the PCB case 19 may be longer than a space between the center above the tub 17 and the left side cover 10*b*. In order to avoid interference (or reduce interference) of the PCB case 19 with other components and compactly configure the PCB case 19 together with the heat pump module 100, the PCB case 19 may be disposed in a downward direction of the left side from a central upper portion of the cabinet 10 when viewed from the front cover 10*d*. The left side of the heat pump module 100 may be positioned between the central upper portion of the cabinet 10 and the upper side of the tub 17, and a space from the left side corner of the cabinet 10 in a downward direction may be larger than a space between the central upper portion of the cabinet 10 and the upper side of the tub 17. Thus, the PCB case 19 may be disposed in a diagonal direction such that a right side thereof may be disposed to face the left side of the heat pump module 100, and a left side of the PCB case 19 may be disposed to face the left side cover 10*b* of the cabinet 10.

In order to stably support the PCB case 19 within the cabinet 10, the PCB case 19 may have a fixing protrusion 191 protruding from one side of an upper surface of the PCB case 19. An upper end portion of the fixing protrusion 191 may have a hook shape. The cabinet 10 may have a fixing member 192 extending from one side of an upper end portion of the front cover 10*d* to one side of an upper end portion of the back cover 10*e* in order to support the PCB case 19. Since the upper end portion of the fixing protrusion 191 is supported to be caught on the side surface of the fixing member 192, the PCB case 19 may be stably supported between the left side corner of the cabinet 10 and the heat pump module 100, and may be compactly disposed.

The PCB case 19 may be electrically connected to the heat pump module 100. Thus, performance of the heat pump module 100 may be inspected in units of modules before a complete product of the clothes treatment apparatus is assembled. Since the PCB case 19 is connected to the heat pump module 100 for performance inspection of the heat pump module 100, the PCB case 19 may be positioned to be close to the heat pump module 100.

Thus, since the PCB case 19 is disposed in a diagonal direction to be close on the side surface of the heat pump module 100 and connected to the heat pump module 100, the PCB case 19 may be compactly installed within the cabinet 10 together with the heat pump module 100.

The compressor 113 may be disposed in the following structure to compactly effectively utilize a space above the tub 17.

Figure 2A:
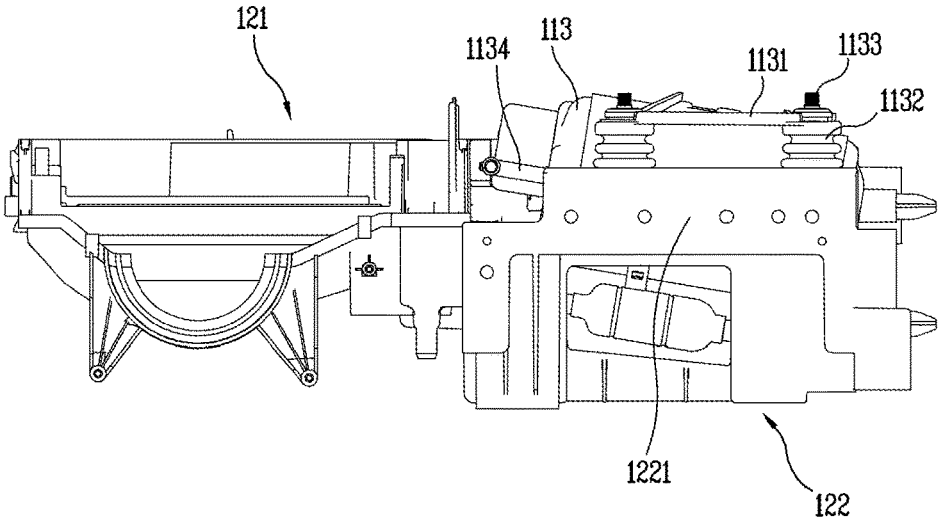
FIG. 2A is a side view of a compressor of FIG. 1B, viewed from the right side.
Figure 2B:
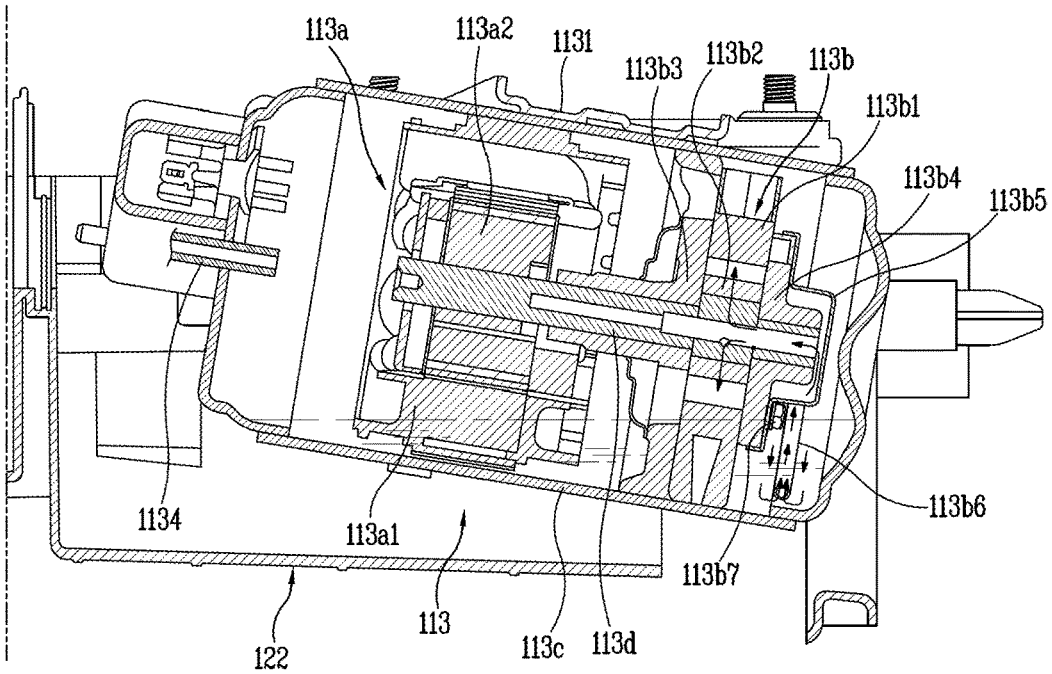
FIG. 2B is a cross-sectional view of the compressor of FIG. 2A.

FIG. 2A is a side view of a compressor of FIG. 1B, viewed from the right side. FIG. 2B is a cross-sectional view of the compressor of FIG. 2A. Other embodiments and configurations may also be provided.

The compressor 113 may be provided as a horizontal compressor 113. The horizontal compressor 113 may have an electric mechanism unit 113*a* and a compression mechanism unit 113*b* together within a compressor casing 113*c*, and may be disposed to be parallel to a support surface. The compressor 113 may be disposed to lie down extendedly in a forward/backward direction of the cabinet 10. The compressor 113 may be disposed such that an outer circumferential surface thereof faces in vertical and horizontal directions and a front surface and a rear surface thereof face a front surface and a rear surface of the cabinet 10, respectively.

The horizontal compressor 113 may be provided such that a lower surface of the compressor base part 122 (i.e., a support surface) may be inclined with respect to a horizontal plane. For example, the horizontal compressor 113 may be installed such that a rear portion of the compressor casing 113*c* is inclined downwardly with respect to a horizontal plane, thereby allowing oil to gather in a side bearing of the compression mechanism unit 113*b*. Accordingly, an oil intake hole for intaking oil may be immersed in oil all the time. Thus, oil may be smoothly supplied to the side bearing of the compression mechanism unit 113*b*. A slope angle of the compressor 113 may range from 3° to 20° with respect to a horizontal line.

The electric mechanism unit 113*a* may be integrally provided within the compressor 113 to provide a rotational force. The electric mechanism unit 113*a* may include a stator

113*a*1 fixed to the compressor casing 113*c*, a rotor 113*a*2 disposed within the stator 113*a*1, and a rotational shaft 113*d* press-fit to an inside of the rotor 113*a*2. The rotational shaft 113*d* may be disposed along a horizontal central line of the compressor casing 113*c*. The rotational shaft 113*d* may be supported by a main bearing 113*b*3 and a sub-bearing 113*b*4.

The compressor 113 may be provided as a rotary compressor 113. The compressor 113 may have a compression mechanism unit 113*b*. The compression mechanism unit 113*b* may include a cylinder 113*b*1 and a rolling piston 113*b*2. The rolling piston 113*b*2 may be eccentrically coupled to an outer circumferential surface of the rotational shaft 113*d*, and may compress a refrigerant, while rotating along an inner circumferential surface of the cylinder 113*b*1. The main bearing 113*b*3 and the sub-bearing 113*b*4 may allow a relative movement between the cylinder 113*b*1 and the rotational shaft 113*d* or between the cylinder 113*b*1 and the rolling piston 113*b*1.

An oil supply unit may include an oil cap 113*b*5, an oil guide pipe 113*b*6 and an oil collecting pipe 113*b*7. The oil cap 113*b*5 may communicate with an end portion of an oil flow channel of the rotational shaft 113*d*, cover an outer surface of the sub-bearing 113*b*4, and have an oil accommodation space therein. The oil guide pipe 113*b*6 may communicate with the oil cap 113*b*5, extend to a lower surface of the casing, and intake oil of the lower surface of the casing to the oil cap 113*b*5. The oil collecting pipe 113*b*7 may communicate with a lower surface of the oil cap 113*b*5 and collect oil to a lower surface of the casing.

Referring to an oil supply path of the compressor 113, when power is applied to the stator 113*a*1 of the motor part 113*a*, the rotor 113*a*2 may rotate according to an interaction with the stator 113*a*1. The rotational shaft 113*d* coupled to the rotor 113*a*2 may rotate to transmit rotational force to the rolling piston 113*b*2 of the compression part 113*b*. As the rolling piston 113*b*2 eccentrically rotates in the internal space of the cylinder 113*b*1, a refrigerant may be sucked into the suction chamber of the cylinder 113*b*1, may be continuously compressed to predetermined pressure, move to a high pressure portion of the casing, and subsequently move to a heat pump cycle through an outlet 1134 formed on a front surface of the casing. Oil at a low pressure portion may be sucked to the oil cap 113*b*5 through the oil guide pipe 113*b*6, and the oil may move along an oil flow channel of the rotational shaft 113*d* and be supplied between the rolling piston 113*b*2 as a sliding portion of the compression part 113*b* and the cylinder 113*b*1 through an oil hole, thus performing a lubricating operation.

The compression mechanism unit 113*b* may be positioned on a front side of the compression casing 113*c*, the electric mechanism unit 113*a* may be positioned on a rear side of the compression casing 113*c*, and the side bearing of the compression mechanism unit may be disposed to be sloped downwardly, whereby oil may be sufficiently supplied to the side bearing of the compression mechanism unit 113*b*.

The refrigerant outlet 1134 (of the compressor 113) may be formed on a front side of the compression casing 113*c* to face the front frame 15 of the cabinet 10 or the circulation fan 130, and a refrigerant inlet 1151*a*1 (of the compressor 113) may be formed on a lower side of an outer circumferential surface of the compressor casing 113*c*.

In order to reduce vibrations and noise generated in the compressor 113, a vibration-proof mount 1132 may be provided on the compressor base part 122 to absorb vibrations of the compressor 113. The fixed bracket 1131 may be welded to at least three positions so as to be fixed to an upper portion of the compressor 113 and cover a portion of an upper outer circumferential surface of the compressor 113. The fixed bracket 1131 may transfer vibrations of the compressor 113 to the vibration-proof mount 1132.

The fixed bracket 1131 and the vibration-proof mount 1132 may be fixed (or attached) to an upper portion of a support formed on a side surface of the compressor base part 122 by a fastening bolt.

Figure 3A:
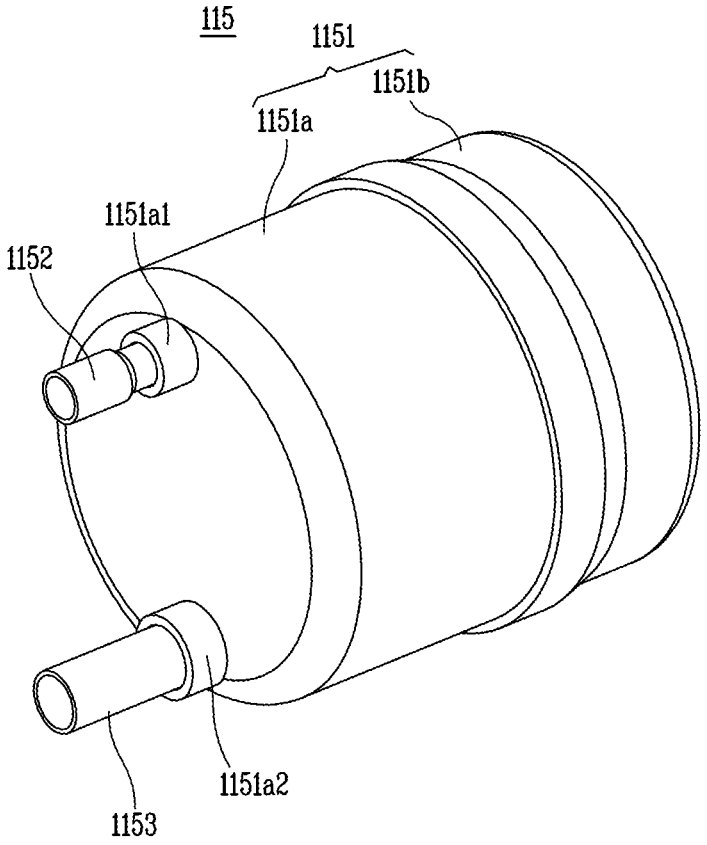
FIG. 3A is a perspective view illustrating a vapor-liquid separator (of FIG. 1B)
Figure 3B:
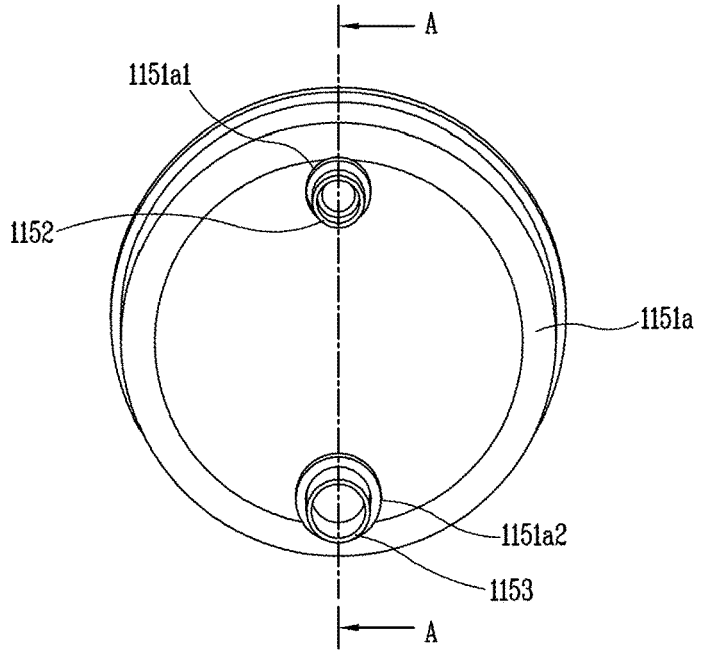
FIG. 3B is a front view of the vapor-liquid separator of FIG. 3A, viewed from the front side.
Figure 4:
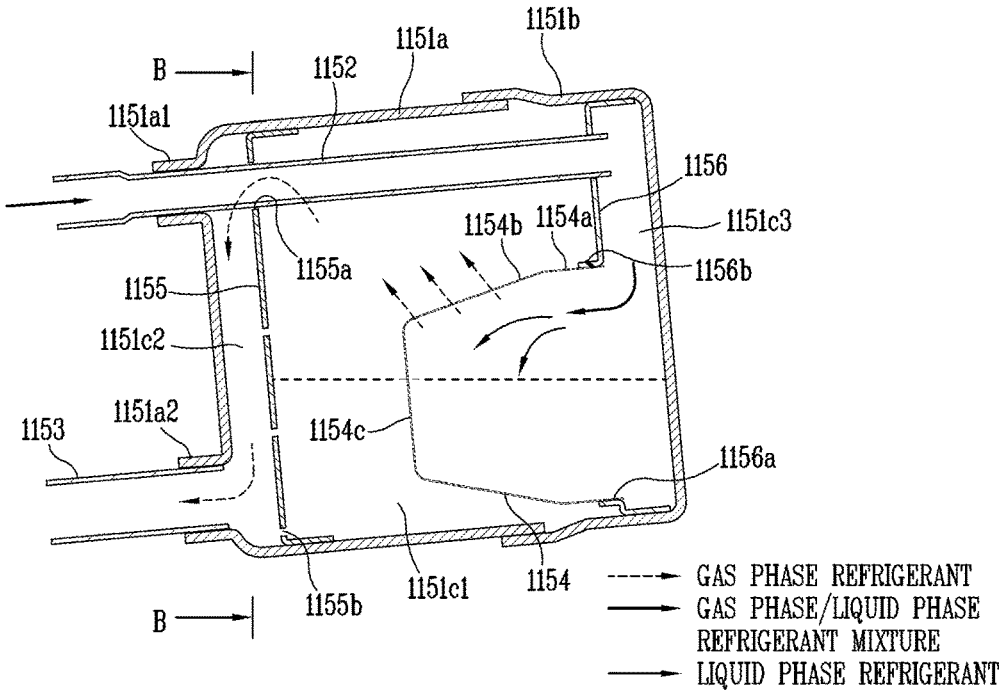
FIG. 4 is a cross-sectional view of FIG. 3B, taken along line A-A.

FIG. 3A is a perspective view illustrating a vapor-liquid separator (of FIG. 1B). FIG. 3B is a front view of the vapor-liquid separator of FIG. 3A, viewed from the front side. FIG. 4 is a cross-sectional view of FIG. 3B, taken along line A-A. Other embodiments and configurations may also be provided.

FIG. 3A illustrates the horizontal vapor-liquid separator 115. The horizontal vapor-liquid separator 115 may be compactly disposed in an internal space of the cabinet 10 together with the compressor 113 (i.e., between an upper portion of the tub and an upper surface of the cabinet 10). For example, the horizontal vapor-liquid separator 115 may be disposed such that a front side thereof is laid down to face a front side of the cabinet 10. The front side of the horizontal vapor-liquid separator 115 may refer to a side seen when the horizontal vapor-liquid separator 115 is viewed at a front side of the cabinet 10. When the heat pump module is mounted above the tub, a front side of the vapor-liquid separator 115 may face a rear side of the heat exchange duct unit 121. Thus, when the compressor 113 and the vapor-liquid separator 115 are viewed from the side cover 10*b* (of the cabinet 10), a height of the vapor-liquid separator 115 may not protrude upwardly or downwardly from the compressor 113, not increasing an overall height of the vapor-liquid separator 115 and the compressor 113. Thus, even when an installation space of the compressor 113 and the vapor-liquid separator 115 is narrow, the compressor 113 and the vapor-liquid separator 115 may be installed and the vapor-liquid separator 115 may be compactly disposed together with the compressor 113.

The horizontal vapor-liquid separator 115 may include a cylindrical casing 1151. An outer circumferential surface (circular curved surface) of the casing 1151 may be disposed to face in vertical and horizontal directions of the cabinet 10. A front side and a rear side of the casing 1151 may be flat surfaces, and an inlet and an outlet may be provided on a front side of the casing. The inlet and outlet may protrude in the same direction. A volume space (having a predetermined size) may be provided within the casing 1151.

The cylindrical casing 1151 (shown in FIG. 4) may include a first casing 1151*a* and a second casing 1151*b* having a cylindrical shape. The first casing 1151*a* may be disposed on the left side, and the second casing 1151*b* may be disposed on the right side, facing each other. End portions of the first casing 1151*a* and the second casing 1151*b* may be assembled in an overlapping manner in a thickness direction to form an airtight space within the casing 1151.

An inlet 1151*a*1 and an outlet 1151*a*2 may be formed on a left side (front side of the casing in FIG. 3B) of the first casing 1151*a*. In order to suck a refrigerant to the inside of the casing 1151, the inlet 1151*a*1 may be formed in an upper portion of a left side of the first casing 1151*a*, and the outlet 1151*a*2 may be formed in a lower portion of the left side of the first casing 1151*a* in order to discharge a refrigerant to the outside of the casing 1151.

The inlet 1151*a*1 may be formed at an upper end portion of the front side of the casing 1151, and the outlet 1151*a*2 may be formed at a lower end portion of the front side of the casing 1151. The inlet 1151*a*1 (of the vapor-liquid separator 115) may be connected to an outlet of the evaporator by a suction pipe 1152. The outlet 1151*a*2 (of the vapor-liquid separator 115) may be connected to an inlet of the compressor 113 by a discharge pipe 1153.

A first partition 1155 and a second partition 1156 may be spaced apart from each other in a length direction within the casing 1151 to divide an internal space of the casing 1151 into three sections. The first partition 1155 may be disposed within the first casing 1151*a*, and the second partition 1156 is disposed within the second casing 1151*b*. Both end portions of the first partition 1155 and the second partition 1156 may be bent by a predetermined length and press-fit to the inside of the first casing 1151*a* and the second casing 1151*b* to reinforce strength of the casing 1151. The first partition 1155 may be parallel to the left side of the first casing 1151*a*, and the second casing 1156 may be parallel to the right side of the second casing 1151*b*. The first partition 1155 and the second partition 1156 may be in a direction perpendicular to outer circumferential surfaces of the first and second casings 1151*a* and 1151*b*. The first partition 1155 may be adjacent to the left side of the first casing 1151*a*. The second partition 1156 may be adjacent to the right side of the second casing 1151*b*.

Among the three internal spaces, an internal space partitioned between the first partition 1155 and the second partition 1156 may be a liquid storage part 1151*c*1 storing a liquid. For example, a liquid phase refrigerant or oil may be temporarily stored in the liquid storage part 1151*c*1.

Additionally, among the three internal spaces, a first internal space partitioned between a left side of the first casing 1151*a* and the first partition 1155 may form a flow channel for discharging a gas phase refrigerant, and a second internal space partition between a right side of the second casing 1151*b* and the second partition 1156 may form a return flow channel 1151*c*3 for returning a mixture of a gas phase refrigerant, a liquid phase refrigerant, and oil.

The suction pipe 1152 may extend from a front side of the casing 1151 (the left side of the casing 1151*a* in FIG. 4) to an internal space of the casing 1151 through the inlet 1151*a*1 and penetrate through the first partition 1155 and the second partition 1156. Accordingly, a mixture of a gas phase refrigerant, a liquid phase refrigerant, oil, and/or the like introduced through the suction pipe 1152 may be independently separated, without being mixed with other fluid, and introduced to the return flow channel 1151*c*3 formed between the second partition 1156 and the right side of the casing 1151. The suction pipe 1152 may be parallel to an outer circumferential surface of the casing 1151.

A return hole 1156*a* may be below the second partition 1156, and may connect the return flow channel 1151*c*3 between the second partition 1156 and the right side of the casing 1151 and the liquid storage part 1151*c*1. Thus, a refrigerant mixture introduced along the suction pipe 1152 may be returned to the liquid storage part 1151*c*1 through the return hole 1156*a*. A diameter of the return hole 1156*a* may be within a range of ⅓ to ¾ of a height of the second partition 1156. One reason for forming the return hole 1156*a* to be large is to secure a large suction and return amount of a refrigerant mixture fluid that has passed through the suction pipe 1152. Additionally, it may secure a storage space of a liquid phase refrigerant and oil as much as possible through the return hole 1156*a*. That is, a liquid phase refrigerant and oil stored in the liquid storage part 1151*c*1 may be moved to the return flow channel 1151*c*3 through the return hole 1156*a*.

The filter unit 1154 (or filter device) may have a net shape, and may be formed of a material such as a metal having a predetermined strength to maintain a predetermined shape. A hole formed in the net may have a fine size, for example, a size of a few to hundreds of μm. For example, the filter unit 1154 may filter out a foreign object such as an iron particle, and/or the like, having a size ranging from 0.01 mm to 1 mm generated in the compressor, the evaporator, and/or the like. When the net is formed of thread, a polymer resin, and/or the like, it may have a separate frame to maintain a predetermined shape. The filter unit 1154 may surround a circumference of the return hole 1156*a* to filter out and remove all the foreign objects included in a returned refrigerant mixture fluid. The filter unit 1154 may form a curved surface protruding from the second partition 1156 toward the first partition 1155, rather than a planar shape. The filter unit 1154 may include an installation part 1154*a* configured as an annular shape, a sloped portion 1154*b* slantingly extending from an end portion of the installation portion 1154*a*, and a connection portion 1154*c* extending in a vertical direction from an end portion of the sloped portion 1154*b*. The installation part 1154*a* (of the filter unit 1154) may be fixed to the second partition 1156 through welding, or the like. The installation part 1154*a* (of the filter unit 1154) may be insertedly coupled to the second partition 1156 in an insertion manner. The second partition 1156 may include an annular filter fixing part 1156*b* for a connection to the filter unit 1154.

While passing through the filter unit 1154 from the liquid storage part 1151*c*1, a liquid phase refrigerant and oil having a specific gravity higher than that of the gas phase refrigerant sink to a lower surface of the liquid storage unit 1151*c*1, while a gas phase refrigerant having a low specific gravity may be moved to an upper side of the liquid storage unit 1151*c*1.

Figure 5:
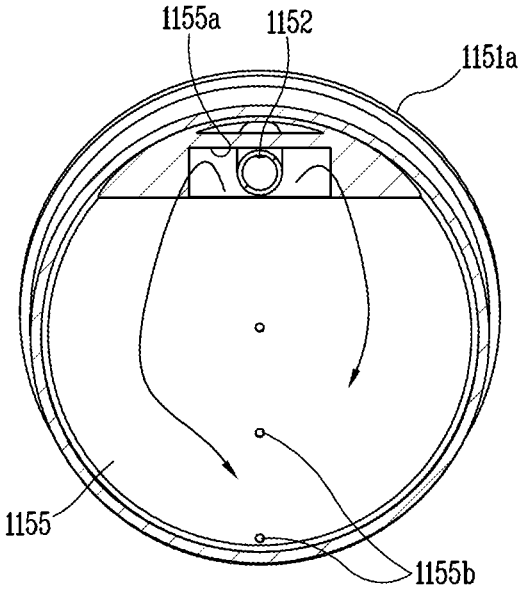
FIG. 5 is a cross-sectional view of FIG. 4, taken along line B-B.
Figure 6:
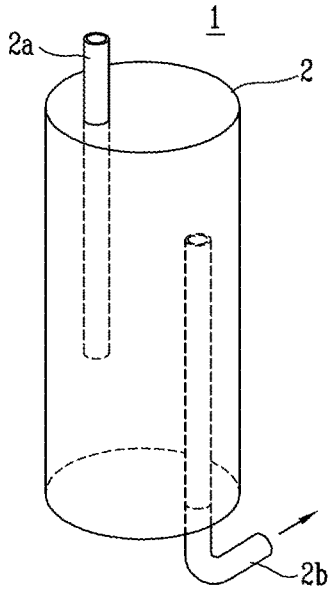
FIG. 6 RELATED ART
FIG. 6 is a perspective view illustrating a vapor-liquid separator according to an example arrangement.
Figure 7:
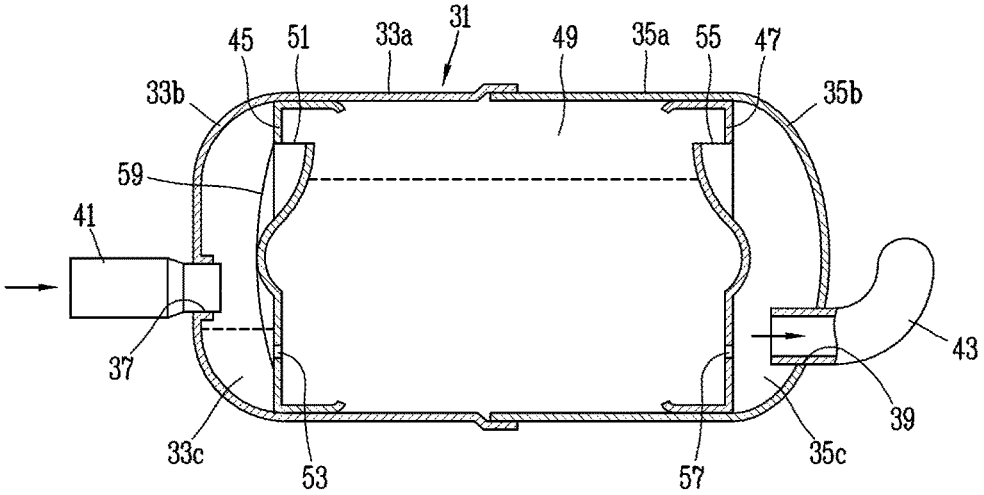
FIG. 7 RELATED ART
FIG. 7 is a cross-sectional view illustrating a horizontal accumulator according to an example document.

FIG. 5 is a cross-sectional view of FIG. 4, taken along line B-B. Other embodiments and configurations may also be provided.

Referring to FIG. 5, a communication hole 1155*a* has a rectangular shape in which a length is long in a horizontal direction in an upper portion of the first partition 1155. The suction pipe 1152 may penetrate through the first partition 1155 through the communication hole 1155*a*. The communication hole 1155*a* may be a hole for a gas phase refrigerant separated in the liquid storage space to move to the first internal space. A vertical length of the communication hole 1155*a* may be substantially the same as a diameter of the suction pipe 1152, and a horizontal length of the communication hole 1155*a* may be longer than a diameter of the suction pipe 1152, so that a gas phase refrigerant may move to the discharge flow channel 1151*c*2 through the communication hole 1155*a*, without being mixed with a gas/liquid phase refrigerant mixture, and may be moved to the compressor 113 through the outlet 1151*a*2 and the discharge pipe 1153 connected to the outlet 1151*a*2.

A refrigerant of the heat pump module 100 may include a portion of oil stored in the compressor 113 in the process of being compressed by the compressor 113, and may circulate to the compressor 113, the condenser 112, the expansion valve, and the evaporator 111. Before the refrigerant is introduced to the compressor 113 from the evaporator 111, the liquid-phase separator 115 may separate oil from the liquid phase refrigerant and return the oil to the compressor 113.

In order to separate oil from the liquid phase refrigerant in the vapor-liquid separator 115, a plurality of oil return holes 1155*b* may be provided (or formed) on the first partition 1155. The oil return hole 1155*b* may be spaced apart from a lower end of the first partition 1155 in an upward direction.

Oil stored in the liquid storage part 1151*c*1 may have a specific gravity greater than that of a liquid phase refrigerant, and thus oil may sink to be lower than the liquid phase refrigerant, and oil has a high possibility of being returned through the oil return hole 1155*b* positioned at the lowermost stage of the plurality of oil return holes 1155*b*.

The oil return hole 1155*b* may be very small, ranging from 1 mm to 3 mm, for example. Thus, even though a portion of the liquid phase refrigerant stored in the liquid storage unit 1151*c*1 flows out through the oil return hole 1155*b*, since it is very small, it is evaporated. The gas phase refrigerant and oil are not mixed with each other.

The casing 1151 may be disposed such that a front side may be lower than a rear side (the right side in FIG. 4) thereof. The casing 1151 may be downwardly sloped toward the discharge pipe 1153 with respect to the top cover 10*a* of the cabinet 10. This may allow oil to easily gather to the outlet 1151*a*2 (of the casing 1151) from the liquid storage part 1151*c*1 by gravitation, to thereby increase a return amount of oil through the oil return hole 1155*b*.

As for the vapor-liquid separator 115 and the clothes treating apparatus the configuration and method according to the embodiments described above are not limited, but the entirety or a portion of the embodiments may be selectively combined to be configured into various modifications.

An embodiment of the detailed description may provide a vapor-liquid separator that is compactly disposed within a cabinet in a small installation space and may avoid interference with respect to an adjacent component, and a clothes treating apparatus having the same.

Another embodiment of the detailed description may provide a vapor-liquid separator capable of separating a gas phase refrigerant and a liquid phase refrigerant although an inlet and an outlet are formed on a same side of a casing, and a clothes treating apparatus having the same.

An object may be achieved by horizontally disposing a vapor-liquid separator such that a central line in parallel to an outer circumferential surface passes through a front side and a rear side of a cabinet. Another object may be achieved by forming an inlet and an outlet on a same side of a casing of the vapor-liquid separator.

To achieve these and other advantages and in accordance with a purpose of this specification, a vapor-liquid separator may include: a casing having an accommodation space therein; an inlet formed in the casing and allowing a refrigerant mixture fluid to be intaken to the accommodation space therethrough; and an outlet formed on the side of the inlet and allowing a gas phase refrigerant (separated from the refrigerant mixture fluid) to be discharged therethrough.

The outlet may be spaced apart from the inlet on the same side, and the inlet may be at an upper portion of the same side, and the outlet may be in a lower portion of the same side.

The vapor-liquid separator may further include a suction pipe that extends to the accommodation space through the inlet.

The vapor-liquid separator may include a first partition that protrudes from a lower surface of the casing in a direction perpendicular to an outer circumferential surface of the casing, facing the inlet and the outlet, and spaced apart from the side on which the inlet and the outlet are provided.

The accommodation space of the casing may be divided (or separated) into a discharge flow channel discharging the gas phase refrigerant and a liquid storage part providing a storage space of a liquid phase refrigerant and oil separated from the refrigerant mixture fluid by the first partition.

A communication hole, connecting the discharge flow channel and the liquid storage part, may be formed at an upper portion of the first partition.

An oil return hole may be formed in the first partition. Oil discharged through the oil return hole may be collected by a compressor, and a liquid phase refrigerant discharged through the oil return hole may be evaporated so as to be collected by the compressor.

The vapor-liquid separator may include a second partition formed within the casing in a direction perpendicular to an outer circumferential surface of the casing, and disposed to be spaced apart from the side of the casing opposing the inlet and the outlet.

The second partition may have a return hole forming a return flow channel of a refrigerant mixture fluid returned toward the outlet.

The second partition may have a filter unit to filter out a foreign object included in the returned refrigerant mixture fluid.

The filter unit may be provided such that one side thereof surrounds the return hole, and the other side protrudes toward the outlet in the second partition.

To achieve these and other advantages and in accordance with the purpose of this specification, a vapor-liquid separator may include: a casing having an inlet and an outlet provided on a same side and having an accommodation space therein; a return flow channel formed within the casing to return a refrigerant mixture fluid toward the outlet in a direction opposite to a direction in which the refrigerant mixture fluid is intaken through the inlet; and a suction pipe that extends from the inlet to the return flow channel.

The return flow channel may be provided on the opposite side of the casing in a direction in which the refrigerant mixture fluid is intaken.

The return flow channel may be formed by a second partition facing the opposite side of the casing and extending in a direction perpendicular to an outer circumferential surface of the casing.

The second partition may have a return hole to return a refrigerant mixture fluid in a direction toward the outlet, and the return hole may be within a range of ⅓ to ¾ of a length of the second partition.

The second partition may include a filter unit to filter out a foreign object, while allowing a refrigerant mixture fluid returned through the return hole to pass therethrough.

To achieve these and other advantages and in accordance with the purpose of this specification, a vapor-liquid separator may include: a casing having an inlet and an outlet provided on a same side and having an accommodation space therein, wherein the casing is disposed such that a central line parallel to an outer circumferential surface is downwardly sloped toward the outlet with respect to a horizontal plane.

The casing may include a first partition dividing (or separating) a storage space of a liquid phase refrigerant and oil separated from a refrigerant mixture fluid intaken through the inlet and a discharge flow channel of a gas phase refrigerant.

The first partition may have a plurality of oil return holes.

To achieve these and other advantages and in accordance with the purpose of this specification, a vapor-liquid separator may include: a casing having an inlet and an outlet provided on one side in a direction in which a central line parallel to an outer circumferential surface passes, and having an accommodation space therein; and a (second) partition having a return flow channel formed on the opposite side of the casing in a direction in which the central line passes, in order to return a refrigerant mixture fluid in a direction opposite to a direction in which the refrigerant mixture fluid is intaken through the inlet.

To achieve these and other advantages and in accordance with the purpose of this specification, a vapor-liquid separator may include: a casing having an inlet and an outlet provided on one side in a direction in which a central line parallel to an outer circumferential surface passes, and having an accommodation space therein; a return flow channel on the opposite side of the casing in a direction in which the central line passes, in order to return a refrigerant mixture fluid in a direction opposite to a direction in which the refrigerant mixture fluid is intaken through the inlet; and a discharge flow channel formed on one side of the casing in a direction in which the central line passes, in order to allow the returned refrigerant mixture fluid to be discharged toward the outlet.

The return flow channel and the discharge flow channel may face the inlet and the outlet, and may be divided (or separated) by a first partition formed in a direction perpendicular to an outer circumferential surface of the casing.

To achieve these and other advantages and in accordance with the purpose of this specification, a clothes treating apparatus may include: a cabinet; a drum rotatably provided within the cabinet and receiving laundry or a dry target; and a heat pump module circulating a refrigerant by an evaporator, a vapor-liquid separator, a compressor, a condenser, and an expansion valve, and circulating air discharged from the drum to the drum by way of the evaporator and the condenser. The vapor-liquid separator may include a casing having an inlet and an outlet in a direction facing a side of the evaporator on the same side when viewed from a front side of the cabinet, and having an accommodation space therein.

The casing may include a suction pipe that extends from the inlet to the accommodation space and that extends to a return flow channel of a refrigerant mixture fluid returned in a direction opposite to a direction in which the refrigerant is intaken through the inlet.

The casing may be provided such that a front side thereof on which the inlet and the outlet are formed is positioned to be lower than a rear side thereof.

The vapor-liquid separator as described above may have the following advantages.

First, since the vapor-liquid separator is disposed horizontally, although it is connected to an inlet of a horizontal compressor, an overall height of the compressor and the vapor-liquid separator may not be increased.

Second, since vapor and a liquid of a refrigerant are separated even though the inlet and the outlet are positioned together on one side of the casing of the vapor-liquid separator, interference with an adjacent component may be avoided.

Third, when the vapor-liquid separator is applied to a clothes treating apparatus, an internal space of a cabinet may be utilized to a maximum level and compactly optimized.

Fourth, a suction pipe may extend from one side of the casing of the vapor-liquid separator to an internal space of the casing to independently configure a suction flow channel of a refrigerant intaken to the inside of the casing and a discharge flow channel of a refrigerant discharged to the outside of the casing, whereby an intaken liquid phase/gas phase mixture may be intake without being mixed with a gas phase refrigerant and only a gas phase refrigerant without a liquid phase refrigerant may be discharged through the communication hole.

Fifth, an oil return hole may be provided in the space in which the liquid phase refrigerant is stored, so that oil may be returned to the compressor.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vapor-liquid separator comprising:

a casing having an accommodation space;

an inlet at a side of the casing, and the inlet to allow a refrigerant mixture fluid to be provided into the accommodation space;

an outlet at the same side of the casing as the inlet, and the outlet to allow a gas phase refrigerant, separated from the refrigerant mixture fluid, to be discharged from the accommodation space; and a first partition extending from a bottom surface of the casing to a top surface of the casing, the first partition dividing the accommodation space into a discharge flow channel that discharges the gas phase refrigerant and a liquid storage part that stores a liquid phase refrigerant, wherein the outlet is provided below the inlet on the same side of the casing.

2. The vapor-liquid separator of claim 1, wherein the outlet is spaced apart from the inlet on the same side of the casing, and the inlet is at an upper portion of the same side of the casing, and the outlet is at a lower portion of the same side of the casing.

3. The vapor-liquid separator of claim 2, further comprising:

a suction pipe that extends through the inlet to the accommodation space.

4. The vapor-liquid separator of claim 3, wherein the first partition to protrude from a surface of the casing in a direction perpendicular to an outer surface of the casing, the first partition to face the inlet and the outlet, and the first partition is spaced apart from the same side of the casing on which the inlet and the outlet are provided.

5. The vapor-liquid separator of claim 4, wherein the accommodation space of the casing includes the discharge flow channel and the liquid storage part, the discharge flow channel to allow the gas phase refrigerant to be discharged, and the liquid storage part to be a storage of the liquid phase refrigerant and oil separated from the refrigerant mixture fluid.

6. The vapor-liquid separator of claim 4, comprising a communication hole at an upper portion of the first partition, the communication hole for connecting the discharge flow channel and the liquid storage part.

7. The vapor-liquid separator of claim 4, further comprising an oil return hole at the first partition, wherein oil discharged through the oil return hole is to be received by a compressor, and the liquid phase refrigerant discharged through the oil return hole is to be evaporated to be collected by the compressor.

8. The vapor-liquid separator of claim 4, further comprising:

a second partition in the casing in the direction perpendicular to the outer surface of the casing, and the second partition is spaced apart from the same side of the casing having the inlet and the outlet.

9. The vapor-liquid separator of claim 8, wherein the second partition includes a return hole to provide a return flow channel for the refrigerant mixture fluid to be provided to the outlet.

10. The vapor-liquid separator of claim 9, wherein the second partition includes a filter to filter a foreign object from the refrigerant mixture fluid.

11. The vapor-liquid separator of claim 10, wherein the filter has a first side that surrounds the return hole and a second side that protrudes toward the outlet.

12. A vapor-liquid separator comprising:

a casing having an inlet and an outlet provided on a same side of the casing, and the casing having an accommodation space;

a return flow channel at the casing to return a refrigerant mixture fluid to the outlet in a direction different from a direction in which the refrigerant mixture fluid is received at the inlet; and a suction pipe that extends through the inlet to the return flow channel, wherein the return flow channel is provided at a different side of the casing as compared to a side in which the refrigerant mixture fluid is provided.

13. The vapor-liquid separator of claim 12, wherein the return flow channel is provided by a partition, and part of the return flow channel extends in a direction perpendicular to an outer circumferential surface of the casing.

14. The vapor-liquid separator of claim 13, wherein the partition has a return hole to provide the refrigerant mixture fluid in a direction toward the outlet, and the return hole is within a range of ⅓ to ¾ of a length of the partition.

15. The vapor-liquid separator of claim 14, wherein the partition includes a filter to filter a foreign object, and to allow the refrigerant mixture fluid to pass therethrough.

16. A vapor-liquid separator comprising:

a casing having an inlet and an outlet provided on a same side of the casing, and the casing having an accommodation space, and a first partition extending from a bottom surface of the casing to a top surface of the casing, the first partition dividing the accommodation space into a discharge flow channel that discharges a gas phase refrigerant and a liquid storage part that stores a liquid phase refrigerant, wherein a central line of the casing parallel to an outer circumferential surface of the casing is downwardly sloped toward the outlet with respect to a horizontal plane, wherein the outlet is provided below the inlet on the same side of the casing.

17. The vapor-liquid separator of claim 16, wherein the first partition separates the liquid storage part of the liquid phase refrigerant and oil separated from the refrigerant mixture fluid from the inlet, and the discharge flow channel of the gas phase refrigerant.

18. The vapor-liquid separator of claim 17, wherein the first partition has a plurality of oil return holes.

19. A vapor-liquid separator comprising:

a casing having an inlet and an outlet provided on a same side of the casing in a direction in which a central line parallel to an outer circumferential surface passes, and the casing having an accommodation space; and a partition having a return flow channel formed at another side of the casing in a direction in which the central line passes, the return flow channel to return a refrigerant mixture fluid in a direction different from a direction in which the refrigerant mixture fluid is received at the inlet, wherein the return flow channel is provided at a different side of the casing as compared to a side in which the refrigerant mixture fluid is provided.

20. A vapor-liquid separator comprising:

a casing having an inlet and an outlet provided on a same side of the casing in a direction in which a central line parallel to an outer surface passes, and the casing having an accommodation space;

a return flow channel formed at another side of the casing in a direction in which the central line passes, the return flow channel to return a refrigerant mixture fluid in a direction different from a direction in which the refrigerant mixture fluid is received from the inlet; and a discharge flow channel to allow the returned refrigerant mixture fluid to be discharged to the outlet, wherein the return flow channel is provided at a different side of the casing as compared to a side in which the refrigerant mixture fluid is provided.

21. The vapor-liquid separator of claim 20, wherein the return flow channel and the discharge flow channel face the inlet and the outlet, and the return flow channel and the discharge flow channel are separated by a partition in a direction perpendicular to an outer surface of the casing.

22. A clothes treating apparatus comprising:

a cabinet;

a drum rotatably provided within the cabinet, and the drum is configured to receive laundry or a dry target;

a heat pump module to circulate a refrigerant by an evaporator, a vapor-liquid separator, a compressor, a condenser, and an expansion valve, and to circulate air discharged from the drum to the drum by using the evaporator and the condenser; and a casing having an inlet and an outlet on a same side of the casing facing the evaporator, and the casing having an accommodation space, a first partition extending from a bottom surface of the casing to a top surface of the casing, the first partition dividing the accommodation space into a discharge flow channel that discharges a gas phase refrigerant and a liquid storage part that stores a liquid phase refrigerant, wherein the outlet is provided below the inlet on the same side of the casing.

23. The clothes treating apparatus of claim 22, wherein the casing includes a suction pipe that extends through the inlet to the accommodation space, and that extends to a return flow channel of a refrigerant mixture fluid.

24. The clothes treating apparatus of claim 22, wherein the casing has a front side on which the inlet and the outlet are provided, and is positioned to be lower than a rear side of the casing.

* * * * *